US009646777B2

(12) United States Patent
Finger et al.

(10) Patent No.: US 9,646,777 B2
(45) Date of Patent: May 9, 2017

(54) ELECTRICAL SWITCHING DEVICE

(71) Applicant: Bernstein AG, Porta Westfalica (DE)

(72) Inventors: Markus Finger, Minden (DE); Michael Schnitker, Uchte (DE)

(73) Assignee: BERNSTEIN AG, Porta Westfalica (DE)

( * ) Notice: Subject to any disclaimer, the term of this patent is extended or adjusted under 35 U.S.C. 154(b) by 0 days.

(21) Appl. No.: 14/752,168

(22) Filed: Jun. 26, 2015

(65) Prior Publication Data

US 2015/0380177 A1 Dec. 31, 2015

(30) Foreign Application Priority Data

Jun. 27, 2014 (DE) ..... 10 2014 109 072

(51) Int. Cl.

| | |
|---|---|
| ***H01H 1/52*** | (2006.01) |
| ***H01H 3/20*** | (2006.01) |
| ***H01H 9/00*** | (2006.01) |
| ***H01H 3/16*** | (2006.01) |
| ***H01H 13/50*** | (2006.01) |
| *H01H 13/18* | (2006.01) |
| *H01H 11/00* | (2006.01) |

(52) U.S. Cl.

CPC ..... *H01H 3/16* (2013.01); *H01H 13/503* (2013.01); *H01H 3/161* (2013.01); *H01H 13/18* (2013.01); *H01H 2011/0025* (2013.01)

(58) Field of Classification Search

CPC .. H01H 9/20; H01H 3/20; H01H 3/16; H01H 13/503; H01H 2011/0025; H01H 3/161; H01H 13/18

USPC ..... 200/321

See application file for complete search history.

(56) References Cited

U.S. PATENT DOCUMENTS

| | | | | |
|---|---|---|---|---|
| 6,198,058 | B1 * | 3/2001 | Graninger | H01H 13/02 200/16 R |
| 6,376,785 | B1 | 4/2002 | Graninger | |
| 2012/0103769 | A1 * | 5/2012 | Jun | H01H 3/20 200/293 |

FOREIGN PATENT DOCUMENTS

| | | |
|---|---|---|
| DE | 60223640 | 10/2008 |
| EP | 1 131 832 B1 | 10/2002 |
| EP | 1302956 | 4/2003 |

* cited by examiner

*Primary Examiner* — Felix O Figueroa
*Assistant Examiner* — Lheiren Mae A Caroc
(74) *Attorney, Agent, or Firm* — Renner, Otto, Boisselle & Sklar, LLP

(57) ABSTRACT

The invention relates to an electrical switching device, in particular a position switch, limit switch, microswitch or other limit stop switch, having at least one housing and one or more electrical switch contacts arranged in the housing, the housing having at least one actuation opening, via which the switch contact(s) can be actuated mechanically from a position outside the housing, the switching device, as a further separate component, having at least one actuator, which has at least one actuation ram that is longitudinally displaceable in the direction of a longitudinal axis of the actuator, the actuator, in a number of different rotation angle positions with regard to the longitudinal axis, being securable to the housing of the switching device in a manner secured against rotation, in such a way that, in the event of external actuation of the actuation ram, the switch contact(s) can be mechanically actuated, a strap being provided as securing means to mechanically secure the actuator to the housing of the switching device, which strap can be slid over at least part of the actuator and at least part of the housing of the switching device.

25 Claims, 4 Drawing Sheets

ELECTRICAL SWITCHING DEVICE

The invention relates to an electrical switching device according to claim 1. The electrical switching device can be formed in particular as a position switch, limit switch, microswitch or other limit stop switch.

Electrical switching devices of this type are used for example in order to monitor mechanical variables, for example in order to switch off electrical machines when a safety door is opened. By way of example, a position sensor having an orientation mechanism is known from EP 1 131 832 B1. A position switch with rotating head is known from EP 1 302 956 B1.

The object of the invention is to specify an electrical switching device that is improved in particular with regard to functionality and producibility.

This object is achieved by an electrical switching device according to claim 1.

The invention has the advantage that mechanically robust components are proposed, which can be produced economically and offer convenient, ergonomic handling for the user. The electrical switch contacts are thus arranged in the housing of the electrical switching device and can be contacted there via cables. An actuator is provided as a further, separate component and can be secured to the housing of the switching device in various rotation angle positions in a manner secured against rotation, which has the advantage that the switching device can be used in a very universal manner and a simple adaptation to different detection tasks is possible by adaptation of the rotation angle position. In order to mechanically connect the actuator to the housing, a strap is proposed, which overlaps both parts, specifically by being slidable over at least part of the actuator and at least part of the housing of the switching device. The sliding motion, which can be guided by corresponding guide grooves, is easily performed by the user. The actuator can be secured to the housing of the switching device in a simple and ergonomic manner.

In accordance with an advantageous development of the invention the strap can be slid only along a straight line of translation over at least part of the actuator and at least part of the housing of the switching device. The degrees of movement freedom with use of the strap to secure the actuator to the housing of the switching device are therefore limited. This simplifies the mounting of the strap for the user.

The actuator can be secured to the housing of the switching device in various rotation angle positions. In particular the actuator may be securable only at various discrete rotation angle positions, for example at certain angular distances. For example, 4, 6, 8 or more discrete rotation angle positions can thus be provided.

In accordance with an advantageous development of the invention the strap has at least one axial fixing means, by means of which the actuator is fixed in the direction of its longitudinal axis in relation to the housing of the switching device. This has the advantage that the actuator can be secured, and is therefore fixed, to the housing of the switching device in the axial direction by means of the strap and therefore by fitting the strap on the housing of the switching device.

In accordance with an advantageous development of the invention the actuator has a peripheral groove, into which a web of the strap dips in order to form the at least one axial fixing means. This has the advantage that the at least one axial fixing means can be provided in a structurally simple manner that can be implemented conveniently in terms of production technology.

In accordance with an advantageous development of the invention the strap has at least one rotation fixing means, by means of which the actuator is fixed with regard to its longitudinal axis in a manner secure against rotation in relation to the housing of the switching device. This has the advantage that the strap, as a further function, also secures the actuator against rotation. A multifunctional strap can thus be provided that combines a large number of advantageous functions in one component. The strap in particular can thus be formed both with the at least one axial fixing means and with the at least one rotation fixing means.

In accordance with an advantageous development of the invention the at least one axial fixing means has an outer form different from the at least one rotation fixing means. In particular the axial fixing means and the rotation fixing means can be formed as different parts of the strap. It is possible to arrange on the strap the at least one axial fixing means at a physical distance from the at least one rotation fixing means. This has the advantage that the same part of the strap does not have to serve as axial fixing means and rotation fixing means. The load on the individual fixing means is thus reduced. In addition, the axial fixing means can be formed independently of the rotation fixing means in terms of design and structure, since both fixing means are decoupled from one another.

In particular, the strap is in direct mechanical contact with the actuator via both the rotation fixing means of said strap and the axial fixing means of said strap, which are separate from the rotation fixing means.

In accordance with an advantageous development of the invention the strap has a rotation fixing means formed as a nub or tooth, which is designed to engage with a recess of a plurality of recesses arranged on the circumference of the actuator. The recesses can be formed for example as blind bores, notches, grooves or other indentations. This has the advantage that the rotation fixing means can be formed already by a single nub or tooth and that in particular there is no need for a number of nubs or teeth in order to provide the protection against rotation. The strap can thus be formed in a structurally simple manner.

In accordance with an advantageous development of the invention the strap can be slid in a direction not parallel with the longitudinal axis of the actuator, in particular in a direction perpendicular thereto, over at least part of the actuator and at least part of the housing of the switching device. The ergonomic handling of the switching device is thus improved further.

In accordance with an advantageous development of the invention the strap has at least one securing means, which is designed to cooperate with at least one receiving means, which is formed as a mating piece and is arranged on the housing of the switching device, in order to secure the strap on the housing of the switching device. This has the advantage that the strap can be secured on the housing of the switching device and therefore no longer can be lost. The securing means can be formed for example as a latching fastening means, which, once the strap has been slid onto the housing of the switching device, latches with the receiving means located there. The latched connection can be formed for example such that it is only releasable again by use of a tool.

In accordance with an advantageous development of the invention the at least one securing means in cooperation with the at least one receiving means allows a limited displaceability of the strap in relation to the housing of the switching device as far as an end stop, in which the strap is still secured to the housing of the switching device. This has the advantage that, as a result of the corresponding displaceability of the strap, a certain residual mobility is enabled, in spite of the securing of the strap to the housing of the switching device, whereby the functionality of the strap can be further extended.

In accordance with an advantageous development of the invention the actuator can be removed from the switching device and/or can be rotated about its longitudinal axis when the at least one securing means is displaced towards the end stop. This has the advantage that the strap does not have to be removed completely from the housing, but the path of displacement within the secured region can be used in order to remove the actuator from the switching device or to fasten the actuator to the switching device, for example in order to change an actuator or to select a desired other rotation angle position of the actuator.

In accordance with an advantageous development of the invention the actuation opening in the housing of the switching device, into which the actuator can be inserted, is formed as a cylindrical or conical opening. Such a purely cylindrical or conical opening has the advantage that it is easily manufactured. There is no need to provide any toothings or the like within the actuation opening in the housing of the switching device, as in the prior art for example, in order to ensure that the actuator is secured against rotation. Instead, the function of the protection against rotation can be provided in the strap, such that the housing of the switching device can be formed more easily and in particular can be manufactured more easily. In particular the tool costs and the production process can be optimized.

In accordance with an advantageous development of the invention the strap has at least one mounting means for the mounting of the switching device on another object. This has the advantage that the strap can also be used at the same time for the mounting of the switching device on another object, for example on a machine or on a protective grating of a machine. As mounting means the strap may have, for example, openings for passing through screws. The functionality of the strap is thus extended further.

In accordance with an advantageous development of the invention the housing of the switching device has a lid secured rotatably via a hinge to a main housing part, which lid can be opened and closed, wherein in the opened state the electrical contacts arranged in the housing are accessible for the connection of electrical cables. This has the advantage that the electrical switch contacts are easily accessible and the housing of the switching device can be securely closed in a simple manner following connection of electrical cables to the electrical switch contacts.

In accordance with an advantageous development of the invention the lid in the closed state covers at least part of the strap. This has the advantage that the lid at the same time can offer a mechanical securing for the strap in order to prevent the displaceability thereof in relation to the housing of the switching device or at least in order to reduce the path of displacement. In particular a displaceability of the strap into a position in which the actuator can be removed from the switching device and/or is rotatable about its longitudinal axis can be prevented by the lid.

The invention will be explained in greater detail hereinafter on the basis of exemplary embodiments with use of drawings.

In the drawings

In the figures, like reference signs are used for elements that correspond to one another.

Figure 1:
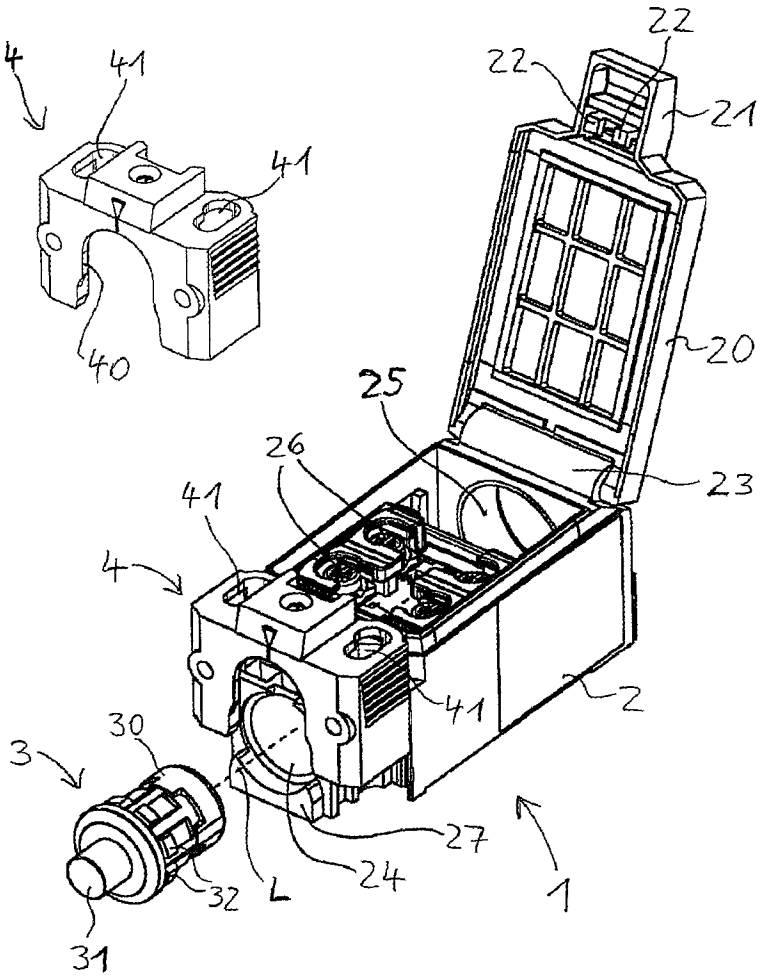
FIG. 1 shows an electrical switching device in an isometric view.

FIG. 1 shows an electrical switching device 1, which has, as separate components to be assembled together, a housing 2, 20, an actuator 3, and also a strap 4. The strap 4 is additionally illustrated separately to the left above the housing 2, 20.

The housing 2, 20 has a main housing part 2 and also a lid 20 secured thereto via a hinge 23. The lid 20 can be pivoted via the hinge 23 and can be folded downwardly from the opened position illustrated in FIG. 1 and thus closes the main housing part 2 upwardly.

Electrical switch contacts 26 are located in the main housing part 2 and can be formed as break contacts, normally open contacts or changeover contact elements as required. A plurality of electrical switch contacts can be provided, which are formed identically or differently in terms of the switching function thereof. In particular one or more of the switch contacts can be formed as slow-action contacts or as snap-action contacts. The switch contacts can also be formed as overlapping break contacts, which only open when an associated normally open contact is closed.

The housing 2, 20 has, on a front side, an actuation opening 24, via which the switch contacts 26 can be actuated mechanically from the outer face of the housing 2, 20. A cable introduction opening 25 is provided on the opposite, rear side of the housing 2, 20. Electrical connection cables can be guided hereby from outside to the switch contacts 26 in order to electrically connect to these.

Figures 4, 5:
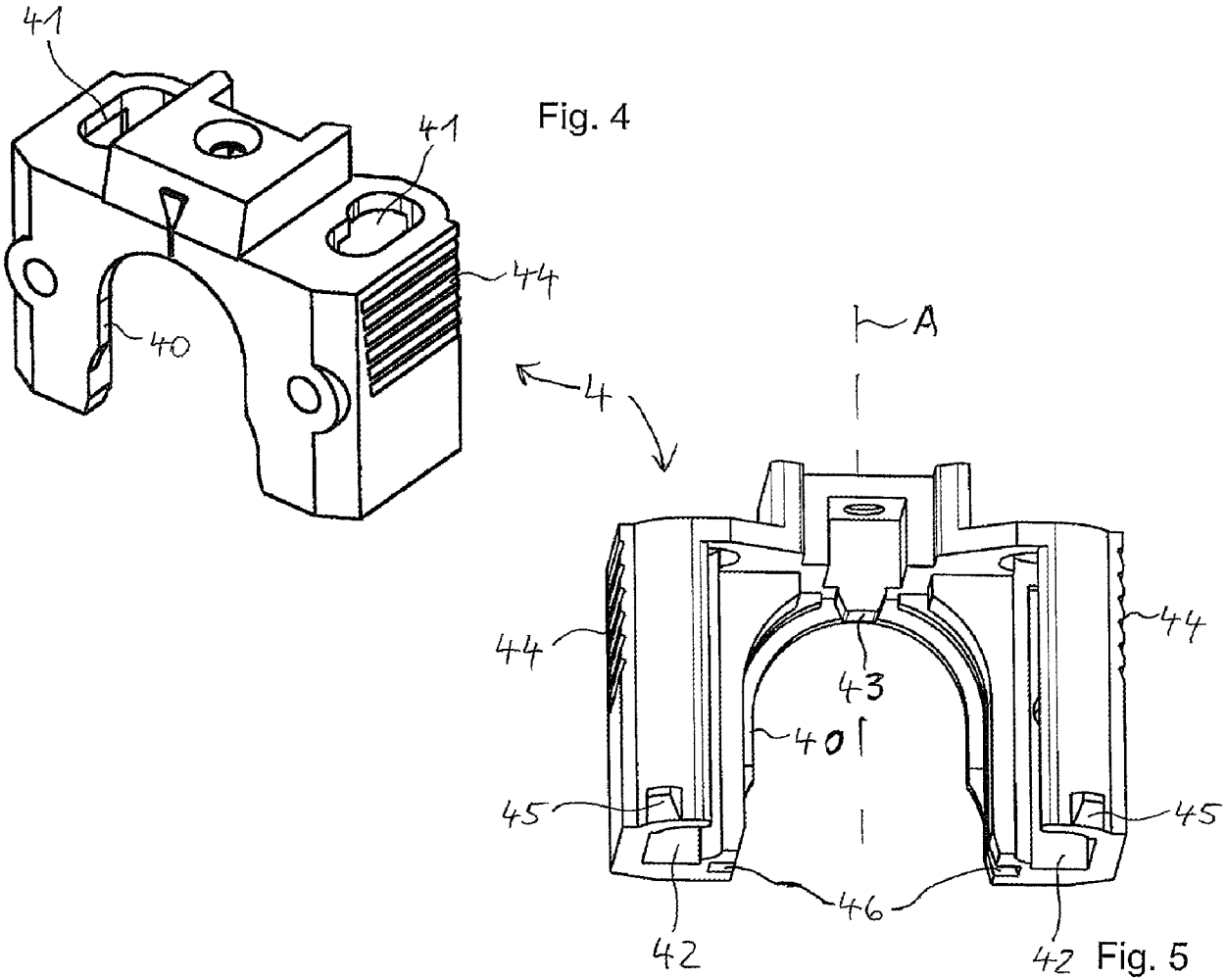
FIGS. 4 and 5 show a strap in various isometric views.

For the mechanical actuation of the electrical switch contacts 26 arranged in the housing 2, 20, a separate component, specifically an actuator 3, is provided. The actuator 3 has a substantially cylindrical body 30. An actuation ram 31, which is longitudinally displaceable along a longitudinal axis L of the actuator 3 and which protrudes from the actuator 3 on the rear side thereof (not visible in FIG. 1) and can thus actuate the switch contacts 26, is located within the body 30. For this purpose the actuator 3 is to be inserted into the actuation opening 24 and then secured thereto. The strap 4 is provided in order to secure the actuator 3 to the housing 2, 20 in the actuation opening 24. The strap 4 can be slid on from above, i.e. in a direction A substantially perpendicular to the longitudinal axis L (as illustrated in FIG. 5), and in so doing covers part of the actuator 3 and part of the main housing part 2.

The strap 4 is, as mentioned, illustrated separately in the upper left corner, moreover in a position at least partially slid onto the main housing part 2. In this position the actuator 3 can be inserted into the actuation opening 24, more specifically in a desired rotation angle position. When the strap 4 is then displaced further downwards, it fixes the actuator 3 at the same time in the axial direction, i.e. against a displacement in the direction of the longitudinal axis L and against a rotation about the longitudinal axis L. The further means necessary for this purpose will be described in greater detail with reference to the following figures.

It can also be seen in FIG. 1 that the strap 4 has two openings as mounting means 41. Screws can be guided through these openings. When the strap 4 is secured to the housing 2, 20, the complete unit, i.e. the switching device 1, can be secured to another object via screws guided by the mounting means 41.

It can also be seen that the lid 20 has a region 21 protruding in the direction of the strap 4. In this protruding region 21, the lid 20 overlaps the strap 4 in the closed state and fixes the strap in relation to the housing 2, 20. Latching means 22 are arranged within the protruding region 21, by means of which latching means the lid 20 can be connected in a latched manner to the main housing part 2 and the housing 2, 20 can be securely closed in this way.

Figure 2:
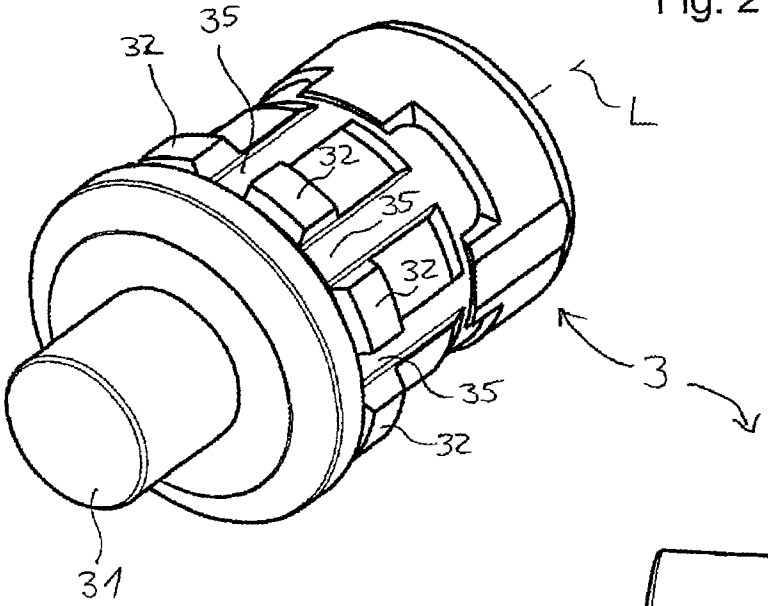
FIGS. 2 and 3 show an actuator in various isometric views.
Figure 3:
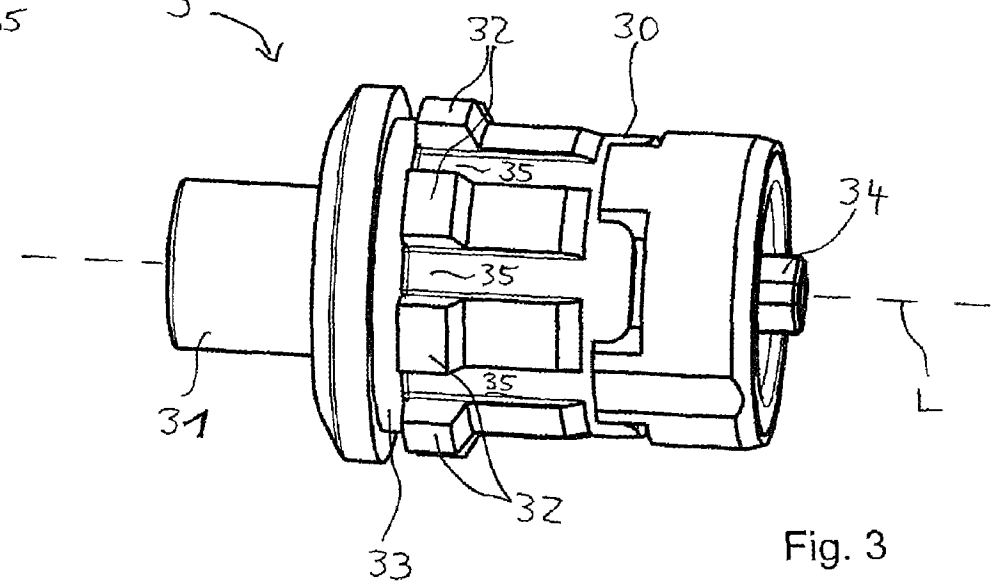

FIGS. 2 and 3 show further details of the actuator. It can be seen that the actuator 31 has an actuation ram 31, 34 passing through. When the actuator 3 is secured to the housing 2, 20, the part 31 of the actuation ram points outwardly. The part 34 points inside the housing 2, 20 and mechanically loads the electrical switch contacts 26 with corresponding actuation of the outer part 31.

It can also be seen that the actuator 3 has, on the outer circumference of its body 30, a peripheral groove 33. This serves, in conjunction with a protruding wall region of the strap 4 formed as an axial fixing means 40, to axial fix the actuator 3 to the housing 2, 20. For protection against rotation, the actuator 3 has, likewise on the outer circumference of the body 30, recesses 35 arranged between projecting protrusions 32. These recesses cooperate with the strap 4, as explained hereinafter.

The strap 4 is visible in FIGS. 4 and 5 in various views, wherein the protruding wall region, which forms the axial fixing means 40, can again be seen. Longitudinal grooves 46 are arranged in the strap 4 in the vicinity of the axial fixing means 40 and overlap the protrusions 32 of the actuator when the strap has been slid on. On an inner side of the protruding wall region, the strap 4 has a projecting tooth or a nub as rotation fixing means 43. This rotation fixing means 43 engages with one of the recesses 35, in order to secure the actuator 3 against rotation.

For improved manual handling, the strap 4 may have flutings 44 on two opposite outer sides, at which the strap is grasped by hand. In order to secure the strap 4 to the housing 2, 20, in particular to the main housing part 2, this has securing means 45 projecting in the direction of the main housing part 2, which securing means for example can be formed similarly to latching fastening means. The securing means 45 cooperate with receiving means arranged on the housing 2, 20, more specifically on the main housing part 2, which receiving means still allow a certain limited displaceability of the strap 4 once the strap 4 has been fitted on the main housing part 2, but prevent a complete removal of the strap 4 from the main housing part 2. Here, the strap 4, in its position illustrated in FIG. 1, can be displaced upwardly in relation to the main housing part 2. In this position the actuator 3 can be inserted into the actuation opening 24 or can be removed therefrom, or another rotation angle position of the actuator 3 can be selected. In order to final fix the actuator 3, the strap 4 is displaced downwardly and is secured via the protruding region 21 of the lid 20. In addition, the strap 4 is secured in its position by screws, which are guided by the mounting means 41.

Figure 7:
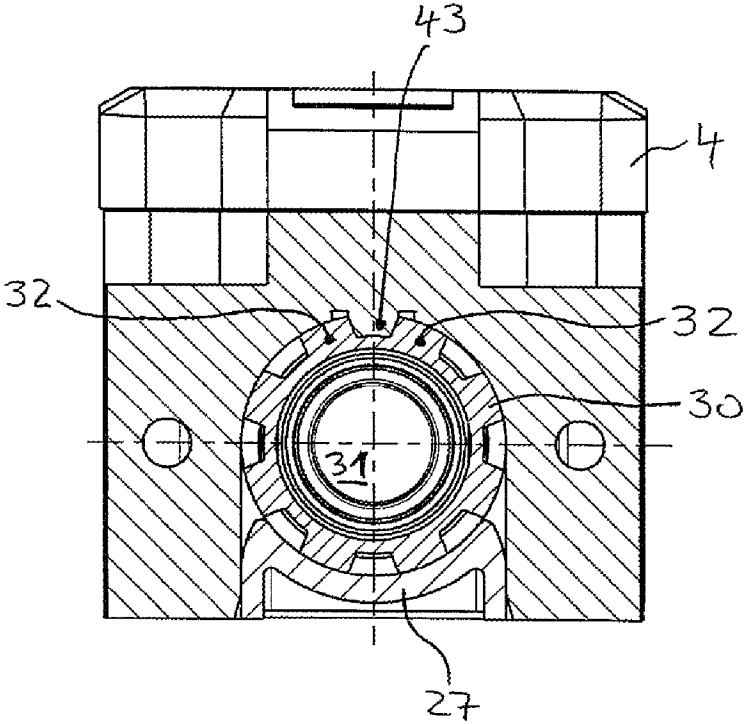

FIG. 7 shows a section through the switching device 1 in a plane through the rotation fixing means 43. It can be seen how the rotation fixing means 43 engages with one of the recesses 35 between two adjacent protrusions 32 and thus secures the actuator 3 against rotation.

Figure 6:
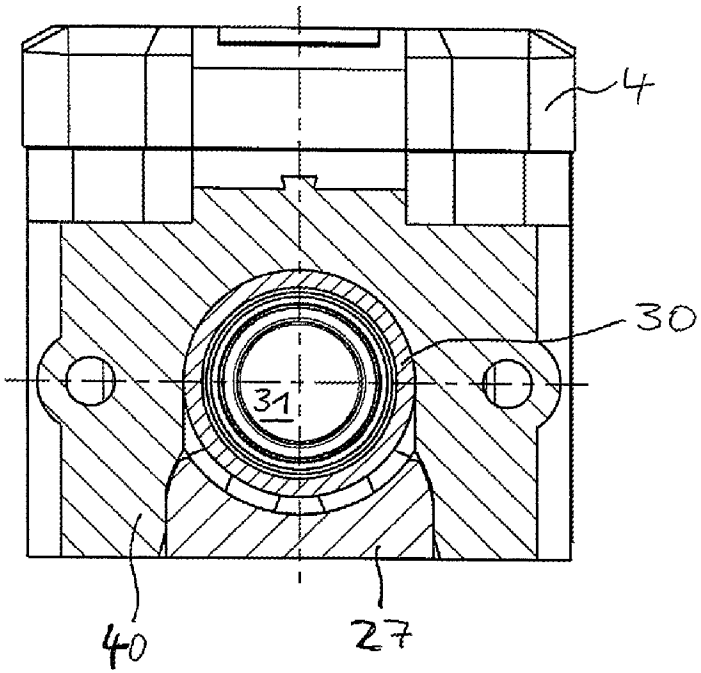
FIGS. 6 and 7 show cross-sectional illustrations through the electrical switching device in various sectional planes.

FIG. 6 shows a section through the switching device 1 in a plane through the axial fixing means 40. It can be seen that the axial fixing means 40 surrounds the actuator 3 over an angular range of approximately 180°. Here, the peripheral groove 33 bears against the axial fixing means 40.

The invention claimed is:

1. An electrical switching device, comprising:

at least one housing; and at least one electrical switch contact arranged in the housing, the housing having at least one actuation opening, via which the at least one electrical switch contact is mechanically actuatable from a position outside the housing;

at least one actuator arranged as a separate component and having at least one actuation ram that is longitudinally displaceable in the direction of a longitudinal axis of the at least one actuator, the at least one actuator being securable to the at least one housing in a number of different rotation angle positions with regard to the longitudinal axis in a manner secured against rotation, wherein the event of external actuation of the at least one actuation ram, the at least one switch contact is mechanically actuated;

a strap configured to mechanically secure the at least one actuator to the at least one housing, wherein when the at least one actuator is inserted into the actuation opening the strap is slidable over at least part of the at least one actuator and at least part of the at least one housing, the strap overlapping the at least one actuator and the at least one housing, wherein the strap comprises at least one rotation fixing device, by means of which the at least one actuator is fixed with regard to a longitudinal axis of the at least one actuator in a manner secure against rotation in relation to the at least one housing.

2. The switching device according to claim 1, wherein the strap comprises at least one axial fixing device, by means of which the at least one actuator is fixed in the direction of a longitudinal axis of the at least one actuator in relation to the at least one housing.

3. The switching device according to claim 2, wherein the at least one actuator comprises a peripheral groove, into which a web of the strap dips in order to form the at least one axial fixing device.

4. The switching device according to claim 1, wherein the at least one axial fixing device has an outer form different from the at least one rotation fixing device.

5. The switching device according to claim 1, wherein the strap comprises a rotation fixing device formed as a nub or tooth, which is configured to engage with a recess of a plurality of recesses arranged on the circumference of the at least one actuator.

6. The switching device according to claim 1, wherein the strap is slidable in a direction not parallel with the longitudinal axis of the at least one actuator over at least part of the at least one actuator and at least part of the at least one housing.

7. The switching device according to claim 6, wherein the strap is slidable in a direction perpendicular to the longitudinal axis of the at least one actuator.

8. The switching device according to claim 1, wherein the strap comprises at least one securing device, which is configured to cooperate with at least one receiving device, which is formed as a mating piece and is arranged on the at least one housing, in order to secure the strap on the at least one housing.

9. The switching device according to claim 8, wherein the at least one securing device in cooperation with the at least one receiving device allows a limited displaceability of the strap in relation to the at least one housing as far as an end stop, in which the strap is still secured to the at least one housing.

10. The switching device according to claim 8, wherein the at least one actuator is removable from the at least one switching device and/or is rotatable about a longitudinal axis of the at least one actuator when the at least one securing device is displaced towards the end stop.

11. The switching device according to claim 1, wherein the actuation opening in the at least one housing, into which the at least one actuator is insertable, is formed as a cylindrical or conical opening.

12. The switching device according to claim 1, wherein the strap comprises at least one mounting device for mounting the at least one switching device on another object.

13. The switching device according to claim 1, wherein the switching device comprises one of a position switch, a limit switch, a microswitch or a limit stop switch.

14. An electrical switching device, comprising:

at least one housing; and at least one electrical switch contact arranged in the housing, the housing having at least one actuation opening, via which the at least one electrical switch contact is mechanically actuatable from a position outside the housing;

at least one actuator arranged as a separate component and having at least one actuation ram that is longitudinally displaceable in the direction of a longitudinal axis of the at least one actuator, the at least one actuator being securable to the at least one housing in a number of different rotation angle positions with regard to the longitudinal axis in a manner secured against rotation, wherein the event of external actuation of the at least one actuation ram, the at least one switch contact is mechanically actuated;

a strap configured to mechanically secure the at least one actuator to the at least one housing, wherein when the at least one actuator is inserted into the actuation opening the strap is slidable over at least part of the at least one actuator and at least part of the at least one housing, the strap overlapping the at least one actuator and the at least one housing, wherein the at least one housing comprises a lid secured rotatably via a hinge to a main housing part of said at least one housing, which lid can be opened and closed, wherein in the opened state the electrical switch contact arranged in the at least one housing is accessible for the connection of electrical cables.

15. The switching device according to claim 14, wherein at least part of the strap is covered by part of the lid when the lid is in the closed state.

16. The switching device according to claim 14, wherein the strap comprises at least one axial fixing device, by means of which the at least one actuator is fixed in the direction of a longitudinal axis of the at least one actuator in relation to the at least one housing.

17. The switching device according to claim 16, wherein the at least one actuator comprises a peripheral groove, into which a web of the strap dips in order to form the at least one axial fixing device.

18. The switching device according to claim 14, wherein the strap is slidable in a direction not parallel with the longitudinal axis of the at least one actuator over at least part of the at least one actuator and at least part of the at least one housing.

19. The switching device according to claim 18, wherein the strap is slidable in a direction perpendicular to the longitudinal axis of the at least one actuator.

20. The switching device according to claim 14, wherein the strap comprises at least one securing device, which is configured to cooperate with at least one receiving device, which is formed as a mating piece and is arranged on the at least one housing, in order to secure the strap on the at least one housing.

21. The switching device according to claim 20, wherein the at least one securing device in cooperation with the at least one receiving device allows a limited displaceability of the strap in relation to the at least one housing as far as an end stop, in which the strap is still secured to the at least one housing.

22. The switching device according to claim 20, wherein the at least one actuator is removable from the at least one switching device and/or is rotatable about a longitudinal axis of the at least one actuator when the at least one securing device is displaced towards the end stop.

23. The switching device according to claim 14, wherein the actuation opening in the at least one housing, into which the at least one actuator is insertable, is formed as a cylindrical or conical opening.

24. The switching device according to claim 14, wherein the strap comprises at least one mounting device for mounting the at least one switching device on another object.

25. The switching device according to claim 14, wherein the switching device comprises one of a position switch, a limit switch, a microswitch or a limit stop switch.

* * * * *